US005771658A

United States Patent [19]

Olson et al.

[11] Patent Number: 5,771,658

[45] Date of Patent: Jun. 30, 1998

[54] ARTICLE PACKAGING APPARATUS

[75] Inventors: Allen L. Olson; Kelly W. Ziegler; Jeffrey A. Lashyro, all of Crosby, Minn.

[73] Assignee: Riverwood International Corporation, Atlanta, Ga.

[21] Appl. No.: 803,526

[22] Filed: Feb. 20, 1997

Related U.S. Application Data

[63] Continuation of Ser. No. 610,994, Mar. 5, 1996, abandoned, which is a continuation of Ser. No. 426,217, Apr. 21, 1995, abandoned, which is a continuation of Ser. No. 399,757, Mar. 7, 1995, abandoned, which is a continuation of Ser. No. 123,142, Sep. 17, 1993, abandoned.

[51] Int. Cl.[6] ..... B65B 35/54

[52] U.S. Cl. ..... 53/157; 53/152; 53/156; 53/238; 53/251; 53/537; 53/540

[58] Field of Search ..... 414/789.5, 791; 198/374, 475.1, 418.3, 418.4; 53/445, 447, 474, 475, 534, 537, 540, 566, 156, 157, 152, 153, 237, 238, 251, 252, 247

[56] References Cited

U.S. PATENT DOCUMENTS

| | | | |
|---|---|---|---|
| 1,824,432 | 9/1931 | Hendry . | |
| 2,561,541 | 7/1951 | Stake . | |
| 2,644,625 | 7/1953 | Currivan . | |
| 2,907,155 | 10/1959 | Engleson et al. . | |
| 3,201,912 | 8/1965 | Wozniak | 53/153 |
| 3,282,585 | 11/1966 | Dieter . | |
| 3,453,800 | 7/1969 | Mahncke . | |
| 3,473,289 | 10/1969 | Vadas | 53/537 X |
| 3,701,407 | 10/1972 | Knlig . | |
| 3,821,874 | 7/1974 | Jones . | |
| 3,845,852 | 11/1974 | Langer et al. . | |
| 3,881,298 | 5/1975 | Griner et al. | 53/540 X |
| 3,900,096 | 8/1975 | Nacketal . | |
| 3,904,036 | 9/1975 | Forrer . | |
| 3,941,236 | 3/1976 | Hagedorn | 53/537 X |
| 4,007,830 | 2/1977 | Calvert . | |
| 4,023,328 | 5/1977 | Calvert et al. . | |
| 4,189,986 | 2/1980 | Silver . | |
| 4,206,579 | 6/1980 | Woxland . | |
| 4,251,978 | 2/1981 | Beck . | |
| 4,380,283 | 4/1983 | Van Maanen . | |
| 4,514,964 | 5/1985 | Langen . | |
| 4,516,765 | 5/1985 | Stocco et al. . | |
| 4,566,248 | 1/1986 | Coolex . | |
| 4,645,061 | 2/1987 | Welch . | |
| 4,646,908 | 3/1987 | Gambetti . | |
| 4,693,055 | 9/1987 | Olsen et al. | 53/566 X |
| 4,709,538 | 12/1987 | Olsen et al. . | |

(List continued on next page.)

FOREIGN PATENT DOCUMENTS

| | | |
|---|---|---|
| 0017333 | 10/1980 | European Pat. Off. . |
| 8300135 | 1/1983 | WIPO . |

OTHER PUBLICATIONS

Kliklok International Ltd., "Kliklok Concorde Medium Speed End Load Cartoner," 2 page brochure.

APV Douglas Machine Corp. Alexandria, Minnesota, Videotape: "M–2207 Continuoius Motion Wraparound Case Packer" Aug. 24, 1990.

APV Douglas Machine Corp. Alexandria, Minnesota, "Mid–America Dairyman CMWACP Floor Plan", Aug. 23, 1989, Drawing No. FR 4690C.

Pillsbury–Mead Machine Videotape, #1225, 129.

*Primary Examiner*—Daniel Moon

*Attorney, Agent, or Firm*—Joel D. Skinner, Jr.; Steve M. McLary

[57] ABSTRACT

An apparatus and method of forming stacked article groups by supplying at least two streams of articles; forming a stream of first article groups having at least one article; placing a support base on a top surface of each first article group; and forming a second article group, having at least one article, on top of the support base of each first article group, whereby stacked article groups are formed. The stacked article groups are subsequently packaged.

16 Claims, 8 Drawing Sheets

U.S. PATENT DOCUMENTS

| | | | |
|---|---|---|---|
| 4,735,600 | 4/1988 | Drewke et al. . | |
| 4,804,076 | 2/1989 | Pace . | |
| 4,817,779 | 4/1989 | Beck et al. . | |
| 4,832,178 | 5/1989 | Anderson et al. . | |
| 4,875,323 | 10/1989 | Craighead | 53/566 X |
| 4,917,229 | 4/1990 | Korkowski . | |
| 4,942,720 | 7/1990 | Berney . | |
| 4,982,551 | 1/1991 | Nigvelli | 53/566 X |
| 5,081,816 | 1/1992 | Cardinali . | |
| 5,101,956 | 4/1992 | Gambetti . | |
| 5,115,902 | 5/1992 | Snyder et al. . | |
| 5,119,985 | 6/1992 | Dawson et al. . | |
| 5,163,271 | 11/1992 | Pan et al. . | |
| 5,175,976 | 1/1993 | Petry et al. . | |
| 5,186,599 | 2/1993 | Fluck . | |
| 5,234,102 | 8/1993 | Schuster et al. . | |
| 5,241,806 | 9/1993 | Ziegler et al. | 53/566 |
| 5,246,113 | 9/1993 | Schuster . | |
| 5,323,587 | 6/1994 | Amaranti | 53/157 X |
| 5,437,143 | 8/1995 | Culpepper et al. | 53/156 X |
| 5,454,211 | 10/1995 | Ziegler et al. | 53/475 |
| 5,456,058 | 10/1995 | Ziegler | 53/447 |

ARTICLE PACKAGING APPARATUS

CROSS REFERENCES TO RELATED APPLICATIONS

This is a continuation of U.S. patent application Ser. No. 08/610,994, filed Mar. 5, 1996, abandoned, which is a continuation of Ser. No. 08/426,217, filed Apr. 21, 1995, abandoned, which is a continuation of U.S. patent application Ser. No. 08/399,757, filed Mar. 7, 1995, abandoned, which is a continuation of U.S. patent application Ser. No. 08/123,142, filed Sep. 17, 1993, abandoned.

BACKGROUND OF THE INVENTION

1. Field of the Invention

This invention relates to packaging methods and apparatus. Particularly, this invention relates to an apparatus for forming stacked or multiple layer article groups outside packaging media, which utilizes a divider panel between top and bottom members of each group. The packaging apparatus of the present invention is usable to package different types, styles and sizes of articles, in a wide range of stacked group patterns, and into a variety of packaging media, in a fast and reliable manner.

2. Background Information

In the past, various apparatus and processes have been proposed and utilized to package selected article groups. Prior art apparatus and processes have limited adjustability, limited output capability, and have been difficult to construct and utilize. And, no process or apparatus, insofar as is known, provides reliable high speed packaging of stacked or layered product groups.

It is an object of this invention to provide an apparatus for reliably forming stacked product groups at high speed. Another object of this invention is to provide a packaging apparatus which is usable with a variety of package types, articles and stacked group configurations and sizes. A particular object of the invention is to provide an apparatus for forming stacked or multiple layer article groups outside of a packaging member, via a base member disposed between a lower article sub-group and an upper article sub-group.

SUMMARY OF THE INVENTION

The present invention provides a packaging apparatus comprising:

(a) a first infeeder supplying a first stream of articles;

(b) a second infeeder supplying a second stream of articles; and (c) a selector having a plurality of spaced flight bars intersecting the first and second article streams at a predetermined angle, the flight bars forming a stream of spaced, stacked article groups, each the stacked article group comprising a lower and an upper article sub-group.

In a preferred embodiment the continuous apparatus for forming and packaging stacked article groups comprises:

(a) a first article infeeder for supplying a first stream of articles in a first travel path;

(b) a second article infeeder for supplying a second stream of articles in a second travel path;

(c) an article group selector having a longitudinal third travel path intersecting the first and second article infeeder travel paths an equivalent angle, the selector having a plurality of spaced, transversely oriented and fixed flight bars intersecting the first and second article streams, the flight bars forming a stream of spaced, stacked article groups, each the stacked article group comprising a lower and an upper article subgroup;

(d) means to deposit a divider member between the upper and lower article subgroups;

(e) a carton supplier having a longitudinal fourth travel path parallel to the selector travel path, the carton supplier forming a stream of cartons with open ends facing the article groups on the selector; and (f) a continuous side loading mechanism having a plurality of loader heads fixed at spaced intervals on endless means disposed about a plurality of drive/idler means, the loader heads being synchronized to contact and move a stacked article group on the selector to a carton on the carton supplier, the loader heads, endless means and drive/idler means being constructed and arranged to form a sloping face whereby the loader heads approach the stacked article groups at an angle and continuously contact the stacked article groups while moving transversely and longitudinally.

The benefits of this invention will become clear from the following description by reference to the drawings.

DESCRIPTION OF THE PREFERRED EMBODIMENTS

Figure 1:
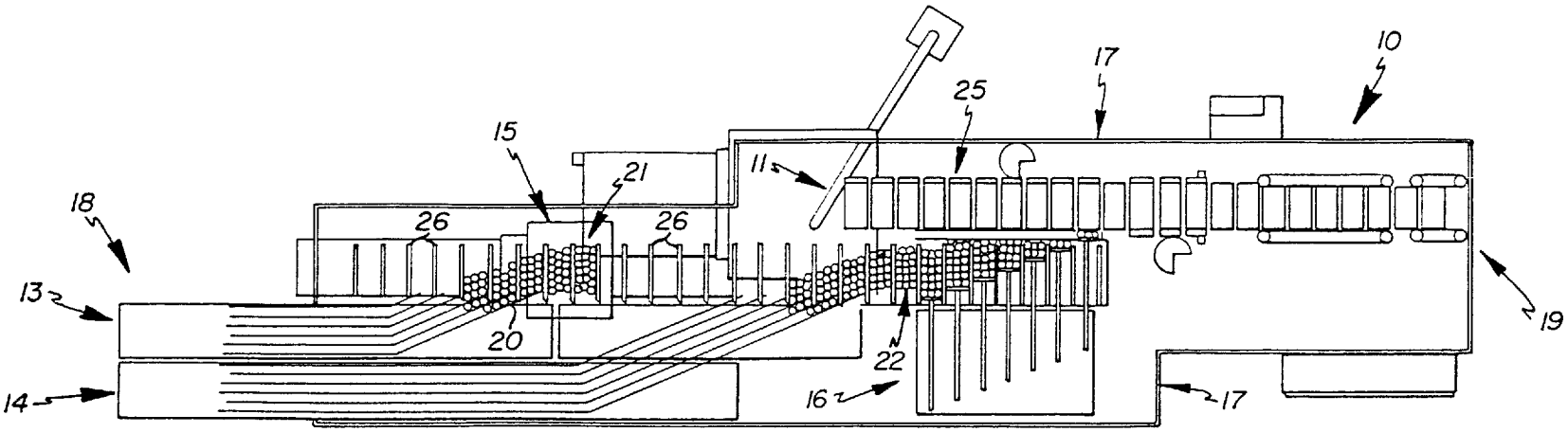
FIG. 1 is a top plan view of one embodiment of the packaging assembly and method provided by the present invention.

The processes and apparatus of the present invention are for forming stacked article groups in a high speed packaging operation. As shown in the drawings, the method of this invention is implemented via a high-speed packaging apparatus. The apparatus is adjustable to provide reliable, continuous and high speed packaging of articles or products of varying types, sizes and quantities into packages of varying types and sizes. For example, the apparatus is usable to load standard twelve ounce beverage cans into 24(12/12), 30(15/15) and 36(18/18) pack stacked combinations. Moreover, the process of loading beverage containers into paperboard cartons, for example, is accomplished quickly and reliably, under typical industry tolerances for both container and carton construction. The resultant filled carton s output by the apparatus are of high quality and consistency, having maximized squareness and tautness for improved storage qualities and transportability. Although the embodiments disclosed load stacked can groups into paperboard cartons, its within the purview of this invention to process the stacked article groups in a variety of ways subsequent their formation, including side loading, shrink wrapping, banding or having paperboard or other material formed around them.

Figure 2:
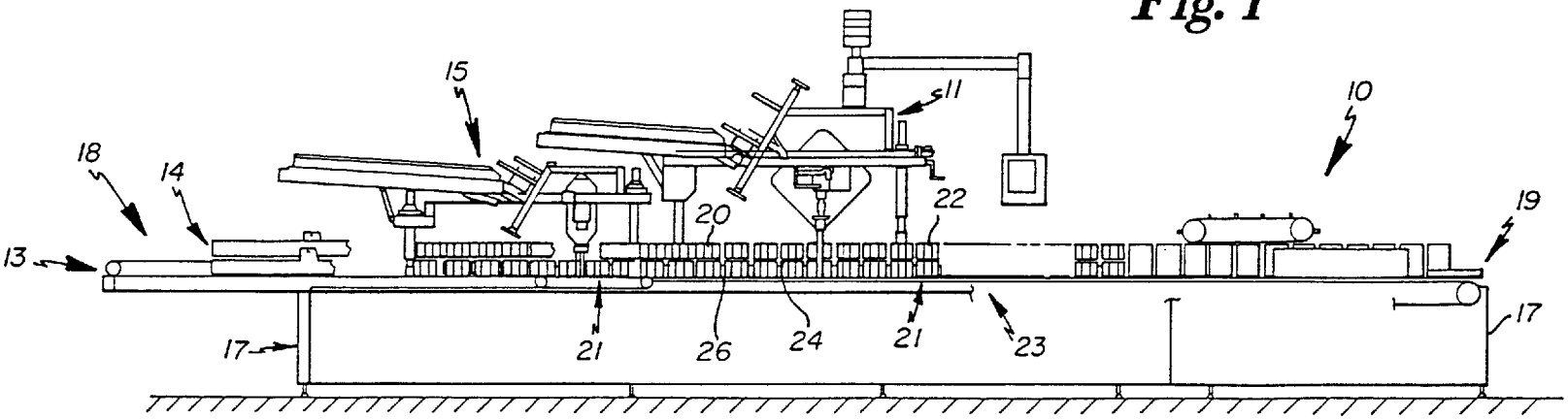
FIG. 2 is a side view of the packaging assembly shown in FIG. 1.
Figure 3:
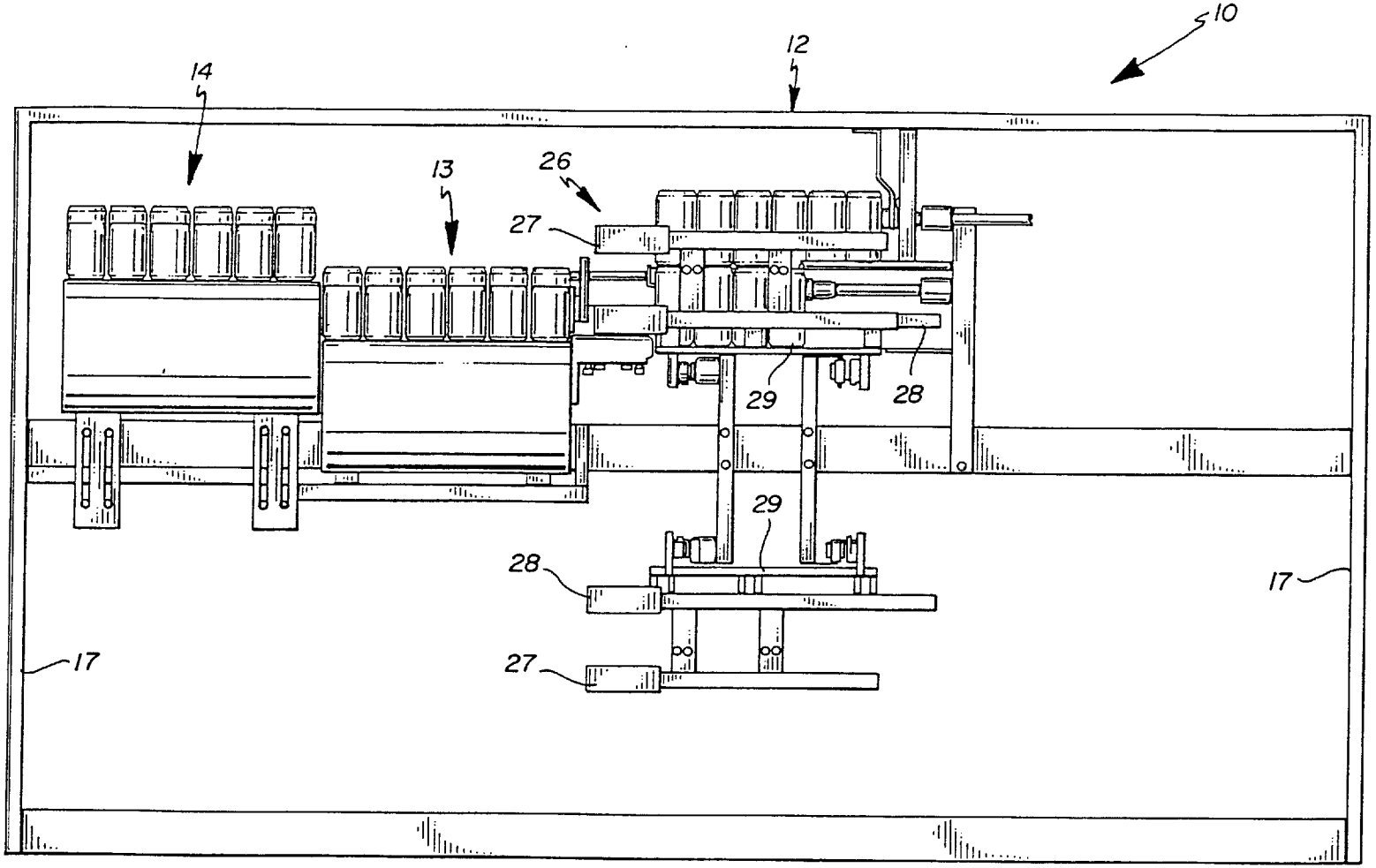
FIG. 3 is a crossectional view of the packaging assembly shown in FIG. 1.

Referring to FIGS. 1 and 2, a first embodiment of the packaging assembly 10 generally comprises a carton supply and transport mechanism or stream 11, an article group selection and transport mechanism or stream 12, a pair of article supply mechanisms or streams 13 and 14, a divider placement mechanism 15, and an article group transfer or cross loading mechanism 16. These mechanisms are shown to be supported by a unitary frame structure 17, although if aligned properly, separate support structures may be utilized consistent with the teachings of this invention.

The carton supply mechanism 11 is shown to be disposed proximate an input end 18 of the assembly 10. Carton sleeves or blanks 25 are subsequently transported in a linear fashion to an output end 21 of the apparatus 10. The article supply mechanisms 13 and 14 are also shown to be disposed at the input end 20 of the apparatus 10. A first portion of each article supply mechanism 13 and 14 is disposed spatially parallel to the article group selection and transport mechanism 12, and a second portion merges, at a predetermined angle, with the article group selection transport mechanism 12 to supply streams of product or articles 20 to two separate positions along the article group selection and transport mechanism 12. These merging mechanisms 12–14 are further constructed and arranged to meter individual articles 20, via a fixed flight bar arrangement, into predetermined stacked article groups 21 and 22 on the mechanism 12.

The stacking function of the device 10 is accomplished by forming a first group 21 at a low level, placing a separator or divider sheet 24 on the lower group 21 via the divider sheet placement mechanism 15, and then simultaneously forming a second group 22 downstream at a higher level and allowing the upper group 22 to slide across the divider sheet 24 by the action of the flight bars 26 of the article group selecting mechanism 12. In an alternative embodiment, the second group may be formed on an upper dead plate and dropped or otherwise deposited onto the divider sheet.

The article group selection and transport mechanism 12 is disposed adjacent and parallel to the carton supply and transport mechanism 11 and extends downstream, in a linear orientation. Merged or combined article groups 23 are transported downstream thereon in a spaced and metered fashion, each group 23 being aligned with a carton 25 traveling on the carton supply and transport mechanism 11.

The cross loading or side loading mechanism 16 is disposed adjacent to and parallel with the second portion of the article group selection and transport mechanism 12, extending and traveling longitudinally with respect to the apparatus 10. The cross loading mechanism 16 has a plurality of loading arms which extend transversely or perpendicularly with respect to the transport mechanisms 11, 13 and 14, to move product groups 23 on the article group selection transport mechanism 12 into aligned cartons 25 traveling on the carton transport mechanism 11, thereby loading the cartons 25 with product groups 23.

Preferably, each of the aforementioned mechanisms 11–14 and 16 has a conveyor type structure with an endless chain or belt configured about rotatable drive and idler end means and moving longitudinally with respect to the input (upstream) and output (downstream) ends 18 and 19 of the apparatus 10. The movement of each mechanism is further synchronized with one another, for example by a common drive and/or gearing means.

Figure 4:
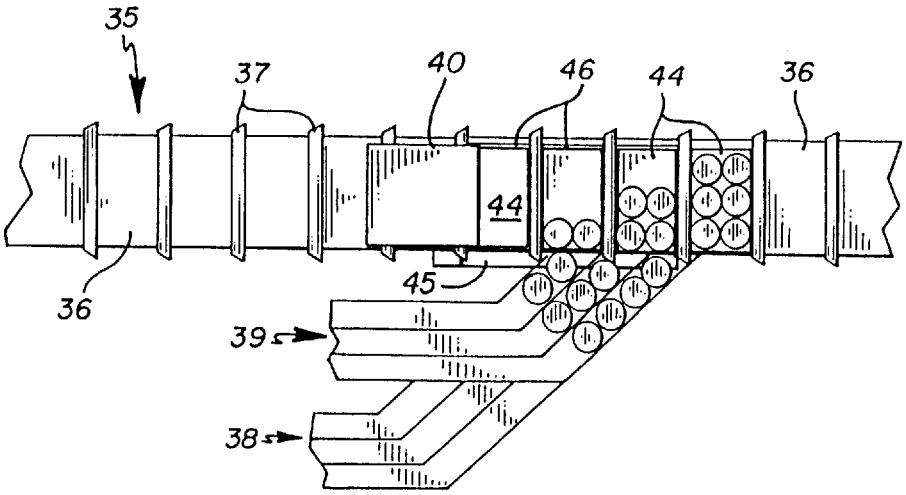
FIG. 4 is a top view of an alternative embodiment of the packaging assembly and method.
Figure 5:
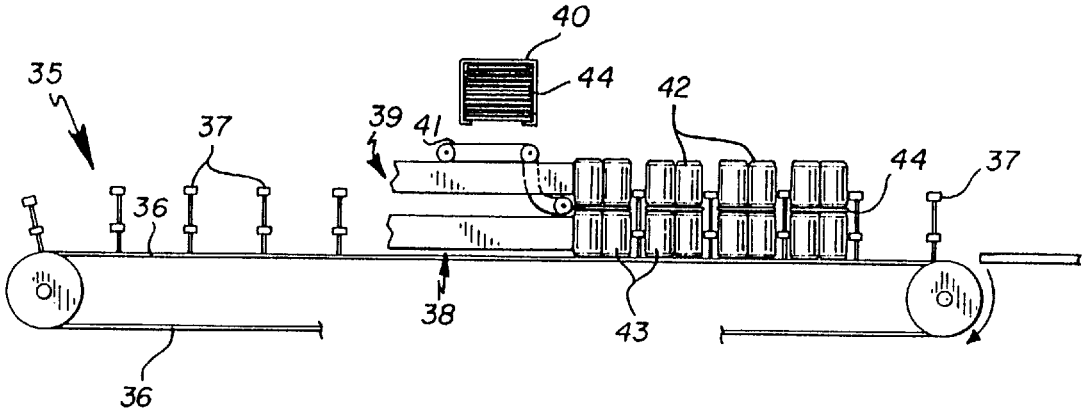
FIG. 5 is a side view of the packaging assembly shown in FIG. 4.

FIGS. 4 and 5 show a second, alternative, embodiment of the method and assembly for forming a stacked article group. Basically, the assembly 35 inputs articles from the same side of the article group selection and transport stream or line and in an aligned orientation. In contrast, the previous embodiment showed article infeed from the same side of the selection and transport line, but in a staggered orientation.

The assembly 35 generally comprises a carton supply and transport mechanism or stream (not shown), an article group selection and transport mechanism or stream 36, a pair of article supply mechanisms or streams 38 and 39, and a divider placement mechanism 40. An article group transfer mechanism or some other form of carton loading or forming mechanism (not shown) is utilized to form carriers or some other form of packaging based on the stacked article groups formed by this mechanism 35. These elements are also preferably supported by a unitary frame structure (not shown), although if aligned properly, separate support structures may be utilized consistent with the teachings of this invention. Each of the aforementioned element also preferably has a conveyor type structure with an endless chain or belt configured about rotatable drive and idler end means and moving longitudinally with respect to the input (upstream) and output (downstream) ends of the apparatus 35. The movement of each mechanism is further preferably synchronized with one another, for example by a common drive and/or gearing means.

The article supply mechanisms 38 and 39 are shown to be disposed at the input end of the apparatus 35. A first portion of each article supply mechanism 38 and 39 is disposed spatially parallel to the article group selection and transport mechanism 36, and a second portion merges, at a predetermined angle, with the article group selection transport mechanism 36 to supply streams of product or articles at a single, aligned position, overhead with respect to each other, along the article group selection and transport mechanism 36. Alternatively, the lines 38 and 39 could angle directly into the selection and transport line 36. These merging mechanisms 36, 38 and 39 are further constructed and arranged to meter individual articles, via a fixed flight bar arrangement 37, into predetermined stacked article groups 42 and 43 on the mechanism 36.

The stacking function of the device 35 is accomplished by forming a first group 43 at a low level, placing a separator or divider sheet 44 on the lower group 43 via the divider sheet placement mechanism 40, and then simultaneously forming a second group 42 at a higher level and allowing the upper group 42 to slide across the divider sheet 44 by the action of the flight bars 37 of the article group selecting mechanism 36. In an alternative embodiment, the second group may be formed on an upper dead plate and dropped or otherwise deposited onto the divider sheet 44.

Figure 6:
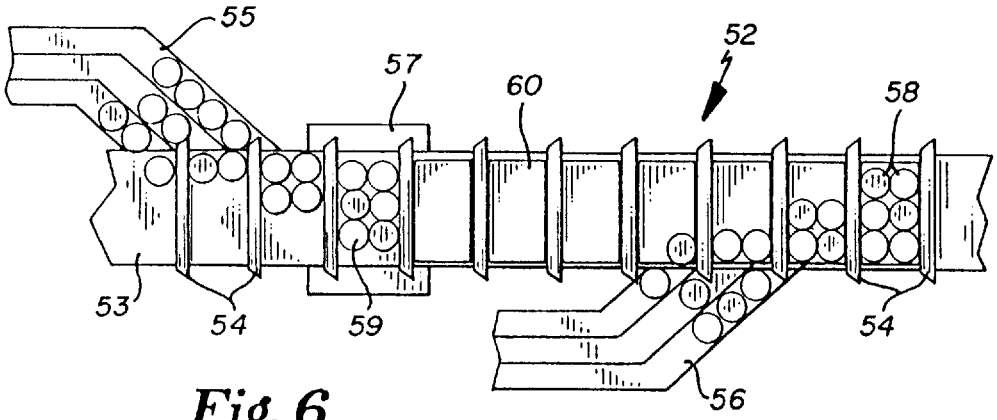
FIG. 6 is a top view of an alternative embodiment of the packaging assembly and method.
Figure 7:
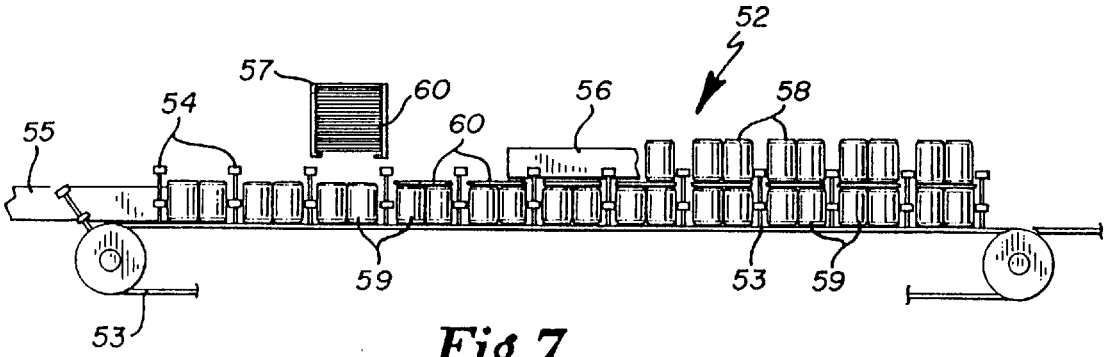
FIG. 7 is a side view of the packaging assembly shown in FIG. 6.

FIGS. 6 and 7 show a third embodiment of the method and assembly for forming a stacked article group. Basically, the assembly 52 inputs articles from opposing sides of the article group selection and transport stream and in a staggered orientation. In contrast, the two preceding embodiments showed article input from the same side of the group selection and transport mechanism.

The assembly 52 generally comprises a carton supply and transport mechanism or stream (not shown), an article group selection and transport mechanism or stream 53, a pair of article supply mechanisms or streams 55 and 56, and a divider placement mechanism 57. An article group transfer mechanism or some other form of carton loading or forming mechanism (not shown) is utilized to form carriers or some other form of packaging based on the stacked article groups formed by this mechanism 52. These elements are also preferably supported by a unitary frame structure (not shown), although if aligned properly, separate support structures may be utilized consistent with the teachings of this invention. Each of the aforementioned element also preferably has a conveyor type structure with an endless chain or belt configured about rotatable drive and idler end means and moving longitudinally with respect to the input (upstream) and output (downstream) ends of the apparatus 52. The movement of each mechanism is further preferably synchronized with one another, for example by a common drive and/or gearing means.

The article supply mechanisms 55 and 56 are preferably disposed at the input end of the apparatus 52, and on opposing sides of the selection and transport line 53. A first portion of each article supply mechanism 55 and 56 is disposed spatially parallel to the article group selection and transport mechanism 36, and a second portion merges, at a predetermined angle, with the article group selection transport mechanism 53 to supply streams of product or articles at two distinct, staggered positions along the article group selection and transport mechanism 53. These merging mechanisms 55, 56 and 53 are further constructed and arranged to meter individual articles, via a fixed flight bar arrangement 54, into predetermined stacked article groups 59 and 58 on the mechanism 52.

The stacking function of the device 52 is accomplished by forming a first group 59 at a low level, placing a separator or divider sheet 60 on the lower group 59 via the divider sheet placement mechanism 57, and then forming a second group 58 at a higher level downstream and allowing the upper group 58 to slide across the divider sheet 60 by the action of the flight bars 54 of the article group selecting mechanism 53.

Figure 8:
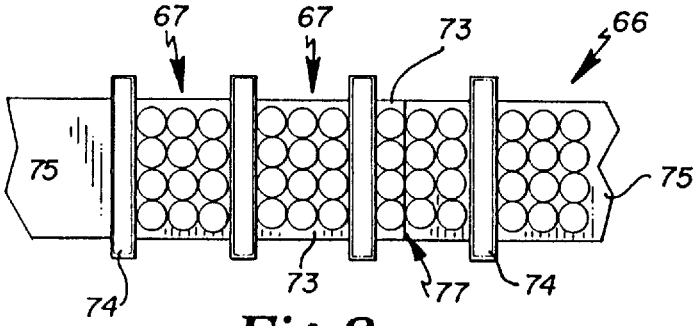
FIG. 8 is a top view of an alternative embodiment of the packaging assembly and method.
Figure 9:
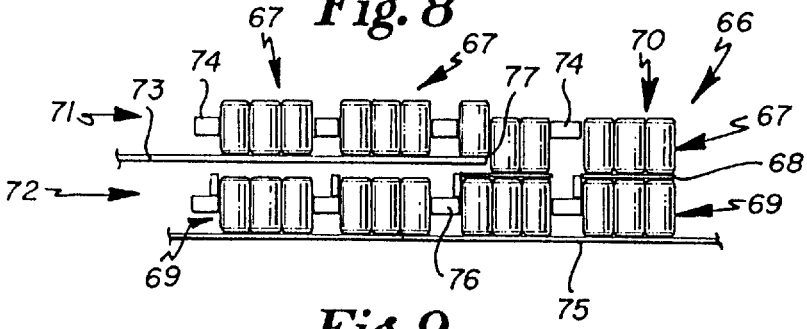
FIG. 9 is a side view of the packaging assembly shown in FIG. 8.

Referring to FIGS. 8 and 9, a portion of a fourth embodiment of the stacked article cartoning apparatus 66 is shown wherein upper article sub-groups 67 are deposited on the top surface of divider sheet 68 on lower article sub-group 69 to form a stacked article group 70. In this embodiment, an upper stream 71 of article sub-groups 67 is disposed above and in longitudinal alignment with a lower stream 72 of article sub-groups 69. The upper stream 71 is shown to include a dead plate 73 across which the upper article sub-groups 67 are moved by the action of upper pusher bars 74. The lower stream 72 includes a conveyor 75 and flight bars 76. As shown, the upper article sub-groups 67 are dropped directly, vertically on top of the divider sheet 68 as they move over the terminal edge 77 of the dead plate. Longitudinal movement of the upper and lower article sub-groups 67 and 69 is synchronized.

Figure 10:
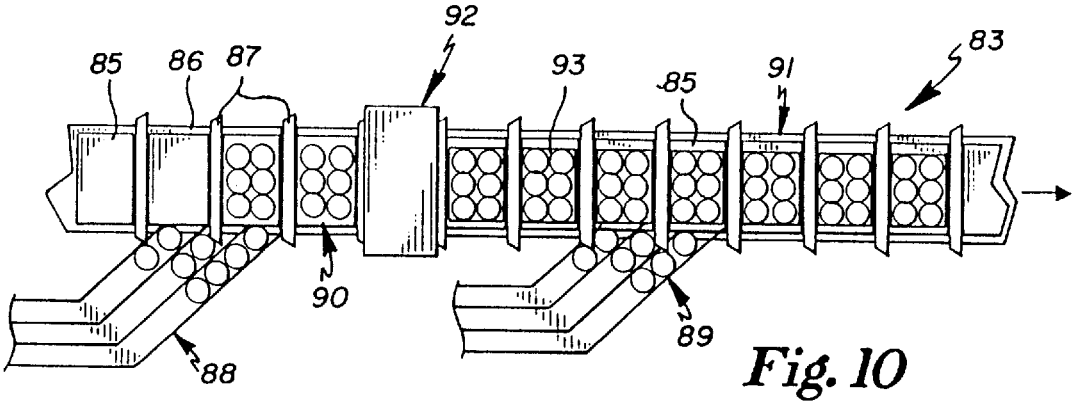
FIG. 10 is a top view of an alternative embodiment of the packaging assembly and method.
Figure 11:
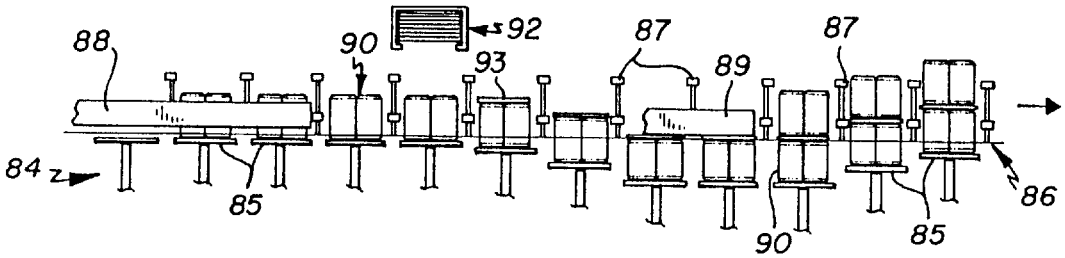
FIG. 11 is a side view of the packaging assembly shown in FIG. 10.

FIGS. 10 and 11 show a fifth embodiment of the method and assembly for forming a stacked article group. Basically, the assembly 83 inputs articles from the same side of the article group selection and transport stream, in a staggered orientation. Importantly, the article input lines are disposed at the same vertical level or plane, while the article group selection and transport line level is vertically indexed to perform the stacking function. In contrast, the preceding embodiments showed article input at two different vertical levels onto a single and constant level selection and transport line.

The assembly 83 generally comprises a carton supply and transport mechanism or stream (not shown), an article group selection and transport mechanism or stream 84, a pair of article supply mechanisms or streams 88 and 89, and a divider placement mechanism 92. An article group transfer mechanism or some other form of carton loading or forming mechanism (not shown) is utilized to form carriers or some other form of packaging based on the stacked article groups formed by this mechanism 83. These elements are also preferably supported by a unitary frame structure (not shown). Each of the aforementioned elements also preferably has a synchronized conveyor type structure with an endless chain or belt configured about rotatable drive and idler end means and moving longitudinally with respect to the input (upstream) and output (downstream) ends of the apparatus 83.

The article supply mechanisms 88 and 89 are shown to be disposed on the same side of the selection and transport line 84, although they may be located on opposing sides as discussed above. Additionally, input is shown in a staggered orientation at distinct points along the longitudinal stream of the selection and transport line 84, although input may be made in an aligned fashion, also as discussed above. These merging mechanisms 84, 88 and 89 are constructed and arranged to meter individual articles, via a fixed flight bar arrangement 87 having upper and lower bars which are shown to be coupled to a separate conveyor 86, into predetermined stacked article groups 90 and 91 on the mechanism 83.

The stacking function of the device 83 is accomplished by forming the first group 90, placing a separator or divider sheet 93 on group 90 via the divider sheet placement mechanism 92, lowering the position of the group 90 as it moves downstream, and then forming a second group 91 at the same vertical level as that at which the first group 90 was formed, downstream, and allowing the second group 91 to slide across the divider sheet 93 by the action of the flight bars 87 of the article group selecting mechanism 84. Importantly, the article group selection and transport mechanism 84 is a lowerator-type mechanism which varies the vertical level of each base platform 85 as it moves downstream, and thus the position of its corresponding transported article group 90. The flight bars 87 are shown to move at a constant level, in synchronization with the lowerator platforms 85. In this orientation, the lower bar functions to select and meter articles, while the upper bar primarily functions to stabilize the formed stacked group.

Figure 12:
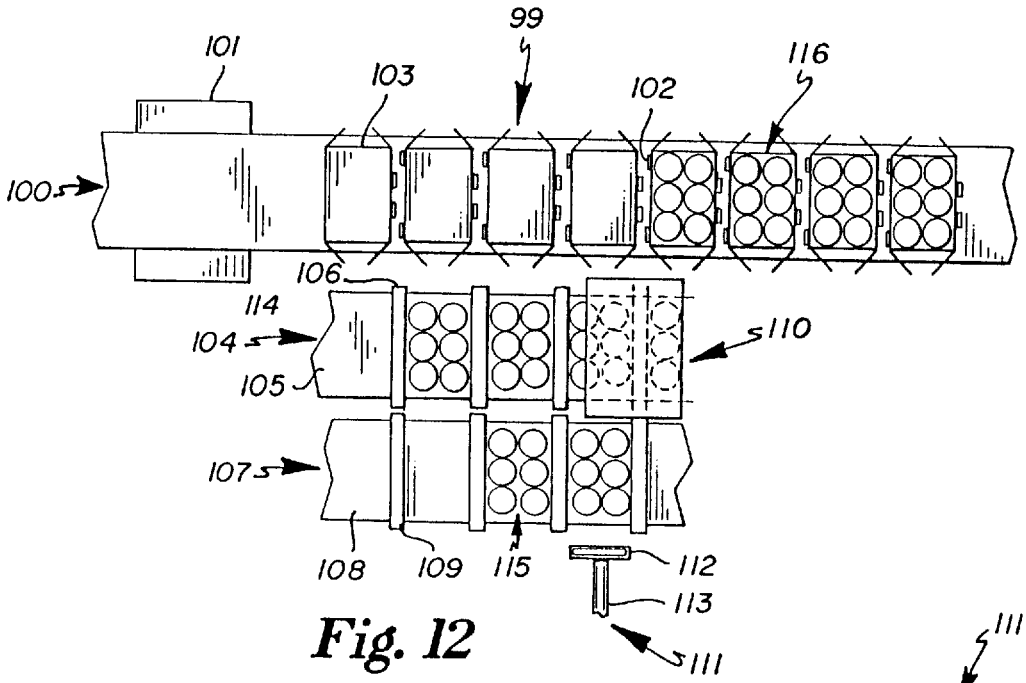
FIG. 12 is a top view of an alternative embodiment of the packaging assembly and method.
Figure 13:
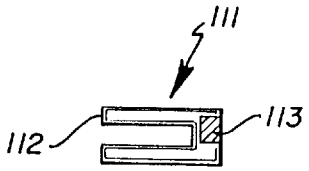
FIG. 13 is a side view, partially in crossection, of the pusher face of the assembly shown in FIG. 12.
Figure 14:
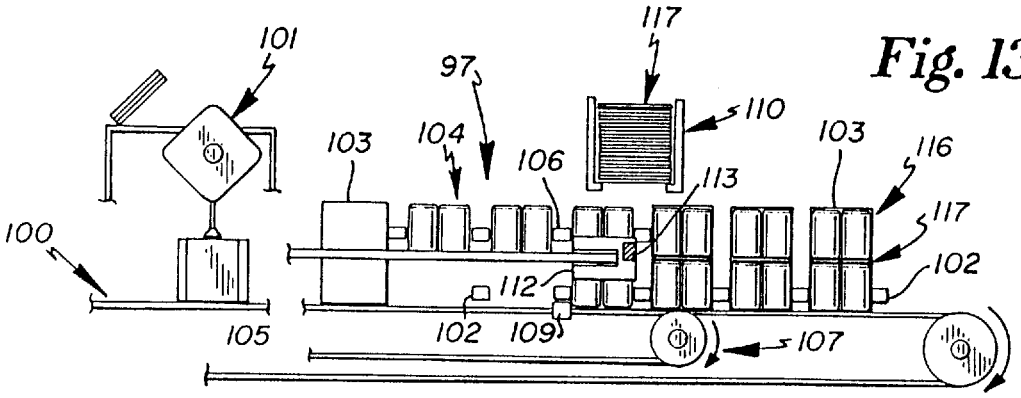
FIG. 14 is a side view of the packaging assembly shown in FIG. 12.

FIGS. 12–14 show a sixth embodiment of the method and assembly for forming a stacked article group. The assembly 99 is an intermittent system, in contrast to the continuous systems discussed above, which loads cartons with stacked article groups formed outside of the package into cartons from the side. The assembly 99 generally comprises a carton set-up line 100, a carton placer 101, a low infeed line 104, a high infeed line 107 a divider placer 110 and a pusher mechanism 111.

Cartons 103 are placed from the carton placer 101, preferably a rotary-type placer, onto the carton set-up conveyor 100, each between conveyor lugs 102, for longitudinal downstream transport. The low infeed line 104 is disposed adjacent the carton set-up line 100 and comprises a conveyor 105 with spaced flight bars 106, between which the low article groups 114 are disposed. The low infeed line 104 is disposed at the same level or plane as that of the carton set-up line 100. The high infeed line 107 is disposed adjacent the low infeed line 104 and comprises a conveyor 108 with spaced flight bars 109 between which high groups 115 are disposed. The high infeed line 107 is disposed at a higher level than that of the low infeed line 104 and carton set-up line 100. The low and high groups 114 and 115 may be placed between the flight bars 106 and 109 respectively, by an upstream selection action as described above, or by other means known in the art.

The flight bars 106 and 109 are shown to be aligned with the lugs 102 of the carton set-up line 100, and the respective conveyors of the carton set-up line 100, low infeed line 104 and high infeed line 107 are synchronized with each other so that the pusher mechanism 111 can laterally move across each line 107 and 104 pushing the article groups 114 and 115 thereon into cartons 103. As the pusher mechanism 111 contacts the high group 115, the divider placer 110 deposits a divider 117 onto the top of the low group 114. The pusher mechanism 111 then moves the high group 115 off of conveyor 108 and across the top surface of the divider sheet 117 to form a stacked article group 116, which is then side loaded into the carton 103 by continued action of the pusher mechanism 111. The reciprocating pusher mechanism 111 comprises a slotted or bifurcated loading face 112 and a loading arm 113 that can pass across the two lines 107 and 104.

Figure 15:
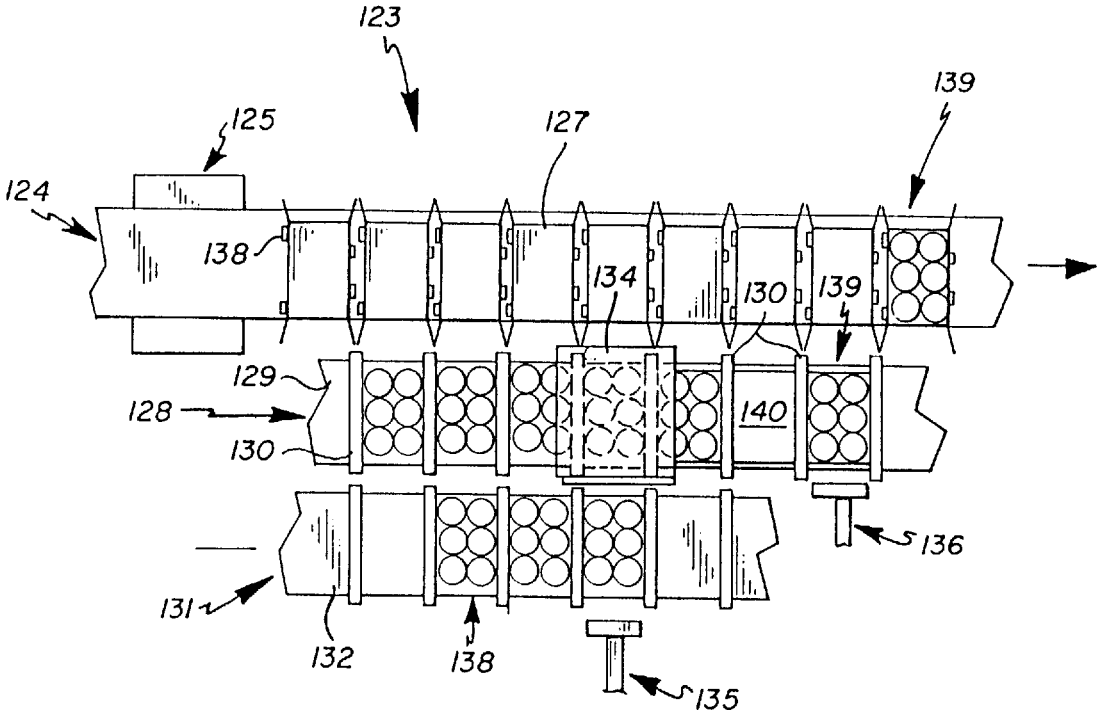
FIG. 15 is a top view of an alternative embodiment of the packaging assembly and method.
Figure 16:
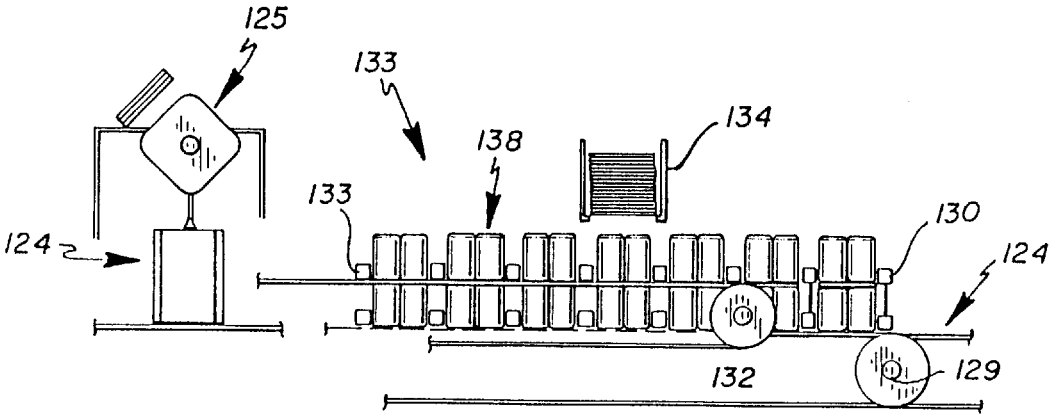
FIG. 16 is a side view of the packaging assembly shown in FIG. 15.

FIGS. 15 and 16 show a seventh embodiment of the method and assembly for forming a stacked article group. The assembly 123 is also an intermittent system which loads cartons with stacked article groups formed outside of the package into cartons from the side. The assembly 123 generally comprises a carton set-up line 124, a carton placer 125, a low infeed line 128, a high infeed line 131 a divider placer 134 and a pair of pusher mechanisms 135 and 136.

Cartons 127 are placed from the carton placer 125, preferably a rotary-type placer, onto the carton set-up conveyor 124, each between conveyor lugs 126, for longitudinal downstream transport. The low infeed line 128 is disposed adjacent the carton set-up line 124 and comprises a conveyor 129 with spaced flight bars 130, between which the low article groups 137 are disposed. The low infeed line 128 is disposed at the same level or plane as that of the carton set-up line 124. The high infeed line 131 is disposed adjacent the low infeed line 128 and comprises a conveyor 132 with spaced flight bars 133 between which high groups 138 are disposed. The high infeed line 131 is disposed at a higher level than that of the low infeed line 128 and carton set-up line 124. The low and high groups 137 and 138 may be placed between the flight bars 130 and 132 respectively, by an upstream selection action as described above, or by other means known in the art.

The flight bars 130 and 132 are shown to be aligned with the lugs 126 of the carton set-up line 124, and the respective conveyors of the carton set-up line 124, low infeed line 128 and high infeed line 131 are synchronized with each other so that the first pusher mechanism 135 can move across each line 131 and 128 pushing the article groups 138 and 137 thereon into cartons 127. As the first pusher mechanism 135 contacts the high group 138, the divider placer 134 deposits a divider 140 onto the top of the low group 137. The pusher mechanism 135 then moves the high group 138 off of conveyor 132 and across the top surface of the divider sheet 140 to form a stacked article group 139, which is then moved downstream on conveyor 129 and aligned with the second pusher mechanism 136. The stacked group 139 is then side loaded into the carton 127 by the lateral action of the second pusher mechanism 136. Both reciprocating pusher mechanisms 135 and 136 comprise a substantially flat, unitary loading face connected to an elongated loading arm.

Figure 17:
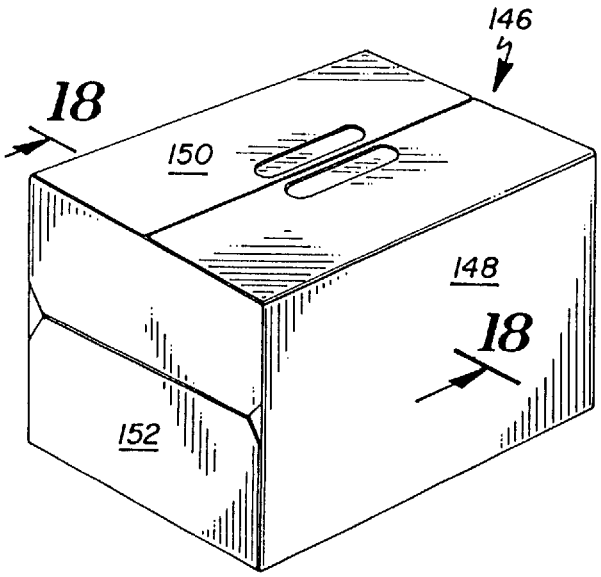
FIG. 17 is a perspective view of an exemplary stacked-type carton as constructed by the apparatus and method of the present invention.
Figure 18:
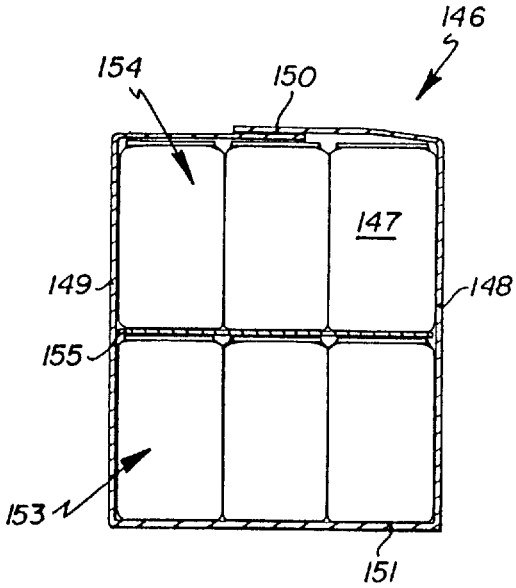
FIG. 18 is a crossectional view of the carton and stacked article group shown in FIG. 17.

Referring to FIGS. 17 and 18, the assembly and method of this invention are usable to construct carriers or cartons 146 containing articles 147 which are layered on top of one another or stacked, as shown by way of example. The paperboard carrier blank or sleeve 146 is comprised of leading and trailing side panels 148 foldably connected to top panel 150 and to a bottom panel 151. End panels 152 connect the top, bottom and side panels 150, 151 and 148. Various alternative end panel structures may be processed by the method and assembly of this invention. As shown, the carrier 146 contains a bottom layer or sub-group 153 of articles, shown for purpose of illustration as beverage cans 147, and an upper layer or sub-group 154 of cans in stacked relationship. The lower ends of the upper cans 154 are supported on a thin, paperboard divider sheet 155 (also referred to as a base or support sheet) with the bottom cans 153 resting on the bottom panel 151. The top panel 150 is disposed closely adjacent, and preferably is in contact with, the top chimes of the upper level 154 of cans to provide for a tight fit between the cans 147 and the carrier 146.

Figure 19:
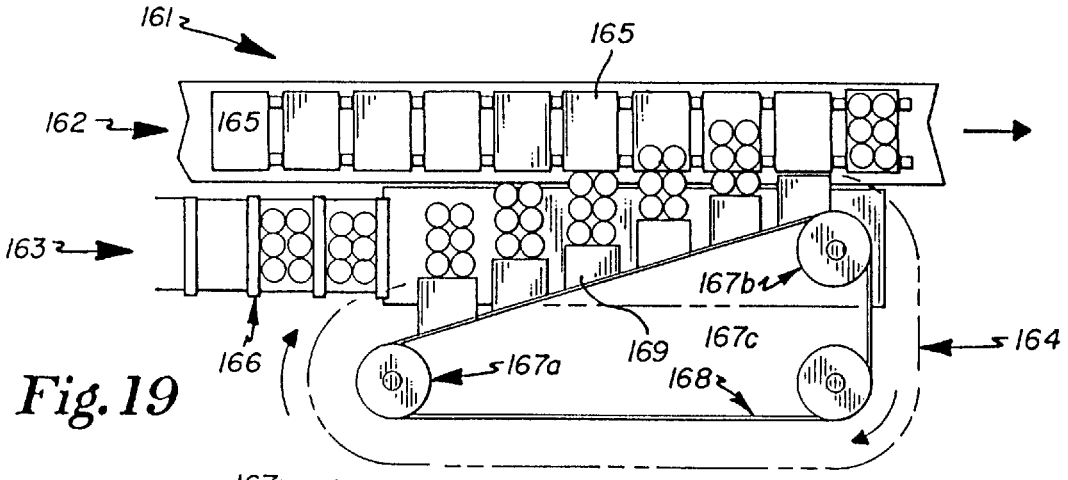
FIG. 19 is a top view of an alternative embodiment of a cross loading or side loading mechanism used with the packaging assembly.
Figure 20:
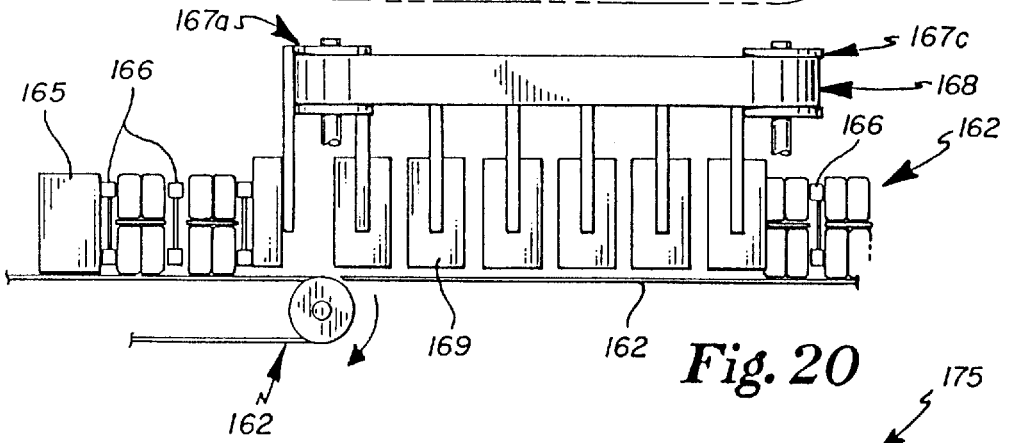
FIG. 20 is a side view of the mechanism shown in FIG. 19.

FIGS. 19 and 20 show an alternative embodiment of a cross loading or side loading mechanism 161 which is usable with the assemblies discussed above. The cross loading mechanism 161 is shown in use with a carton transport line 162 and an article group transport line 163, transporting cartons 165 and stacked article groups 166, respectively. The side loading mechanism 161 generally comprises three pully/shaft assemblies 167*a,b,c*, at least one drive chain or belt 168 connected to the assemblies 167, and a plurality of loader heads 169 connected to the chain 168. The mechanism 161 is shown to have a sloping face wherein the loader heads 169 approach the article group transport mechanism 163 at an angle. The loader heads 169 are further aligned with the article groups 166 and the cartons 165 such that as the heads 169 angle inwardly, they continuously contact the article groups 166 and move them across the line 163 and into the aligned and synchronized cartons 165. Importantly, the loader heads 169 have a predetermined height such that they contact and support the tall side face of the stacked article group 166.

Figure 21:
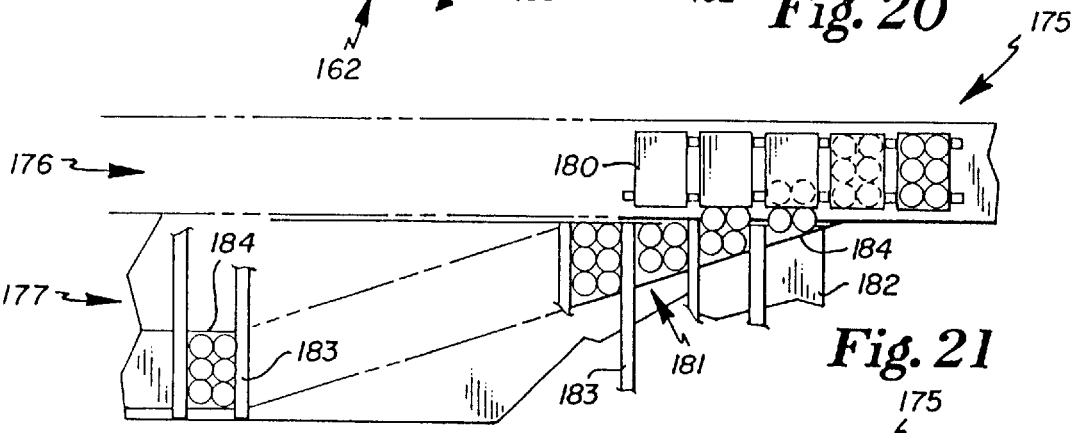
FIG. 21 is a top view of an alternative embodiment of the cross loading mechanism.
Figure 22:
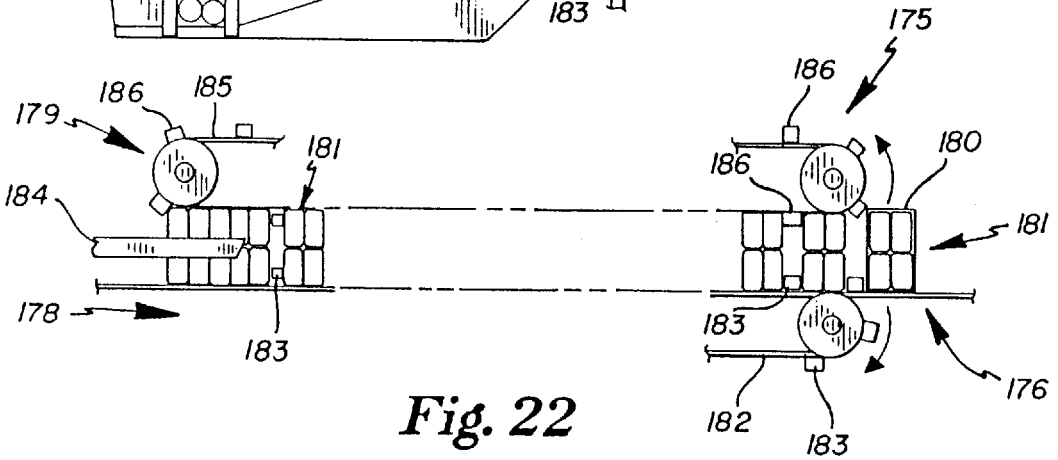
FIG. 22 is a side view of the mechanism shown in FIG. 21.

FIGS. 21 and 22 show an alternative embodiment of a cross loading or side loading mechanism 175 which is usable with the assemblies discussed above. The cross loading mechanism 175 is shown in use with a carton transport line 176 and an article group transport line 177, transporting cartons 180 and stacked article groups 181, respectively. The side loading mechanism 175 generally comprises a lower member 178 and an upper member 179. The lower member 178 includes a conveyor 182 which is disposed adjacent the article group transport line 177 and a plurality of flight bars 183 connected to the conveyor 182 which contact a lower portion of each stacked article group 181. The upper member 179 is disposed directly over head relative to the lower member 178 and includes a conveyor 185 and a plurality of flight bars 186 which contact an upper portion of each stacked article group 181. The mechanism 175 further comprises a pair of guide rails 184 which have a predetermined configuration and are disposed at a vertical level which is between the flights 183 and 186. Further, the guide rails 184 are disposed a predetermined distance apart to accommodate the dimensions of an article group 181, and angle towards the carton transport line 176. The conveyors 182 and 185 are synchronized and the flights 183 and 186 are aligned so that the top and bottom portions of the stacked article group 181 are stabilized and moved along an identical travel path for side loading into the cartons 180.

Although the apparatus shown in the drawings are utilized in a beverage can cartoning operation with paperboard carrier sleeves, modifications consistent with the teachings of this invention may be made to package various other stacked containers or articles, in various carrier configurations, or to package the article groups via shrink wrapping, banding or the like.

The descriptions above and the accompanying drawings should be interpreted in the illustrative and not the limited sense. While the invention has been disclosed in connection with the preferred embodiments thereof, it should be understood that there may be other embodiments which fall within the spirit and scope of the invention as defined by the following claims. Where a claim is expressed as a means or step for performing a specified function it is intended that such claim be construed to cover the corresponding structure, material, or acts described in the specification and equivalents thereof, including both structural equivalents and equivalent structures.

What is claimed:

1. A continuous motion, stacking packaging apparatus comprising:

(a) a first infeeder supplying a first stream of articles;

(b) a second infeeder supplying a second stream of articles, said first and second infeeders being disposed at vertically separate and distinct horizontal planes; and (c) a selector having a plurality of spaced flight bars intersecting said first and second article streams at a predetermined angle, said flight bars forming lower and upper article sub-groups and a stream of spaced, stacked article groups, each said stacked article group comprising said lower and an upper article subgroup, and (d) each said infeeder having a plurality of article lanes, said article lanes intersecting said selector at said predetermined angle, and wherein said flight bars form said upper and lower article subgroups by selecting articles from said article lanes, said selector further slidingly forming said upper article subgroups over and with respect to said lower article subgroups to form said stacked article groups.

2. The packaging apparatus of claim 1, wherein said apparatus operates continuously.

3. The packaging apparatus of claim 1, further comprising:

(d) a carton supplier forming a stream of cartons with open ends facing said article groups on said selector; and (e) a transfer mechanism for loading article groups from said selector to cartons on said carton supplier.

4. The packaging apparatus of claim 3, wherein said cartons are constructed of paperboard.

5. The packaging apparatus of claim 3, wherein said transfer mechanism is a continuous side loading mechanism having a plurality of loader heads fixed at spaced intervals on endless means disposed about a plurality of drive/idler means, said loader heads being synchronized to contact and move a stacked article group on said selector to a carton on said carton supplier.

6. The packaging apparatus of claim 5, wherein said loader heads, endless means and drive/idler means are constructed and arranged to form a sloping face whereby said loader heads approach said stacked article groups at an angle and continuously contact said stacked article groups while moving transversely and longitudinally.

7. The packaging apparatus of claim 6, wherein said loader heads have a predetermined height for contacting said stacked article groups.

8. The packaging apparatus of claim 1, further comprising a divider deposit mechanism for depositing a divider member on a top surface of said lower article subgroup.

9. The packaging apparatus of claim 8, wherein said selector has a predetermined longitudinal travel path, and wherein said selector forms said lower article subgroup and said upper article subgroup at a first longitudinal position on said selector travel path, and wherein said divider deposit mechanism places a divider member between said lower and upper article subgroups at said first longitudinal position on said selector travel path.

10. The packaging apparatus of claim 8, wherein said divider member is constructed of paperboard.

11. The packaging apparatus of claim 10, wherein said divider member has a thin, substantially flat, rectilinear configuration with a surface area substantially coextensive with that of a top surface of said lower article subgroup.

12. The packaging apparatus of claim 8, wherein said selector has a predetermined longitudinal travel path, and wherein said selector forms said lower article subgroup at a first longitudinal position on said selector travel path and forms said upper article subgroup at a second longitudinal position on said selector travel path, and wherein said divider deposit mechanism places a divider member on said lower article subgroup at a third longitudinal position on said selector travel path, between said first and second longitudinal positions.

13. The packaging apparatus of claim 12, wherein said first infeeder is disposed at a first lateral side of said selector and said second infeeder is disposed at a second lateral side of said selector.

14. The packaging apparatus of claim 12, wherein said first infeeder is disposed at a first lateral side of said selector and said second infeeder is disposed at said first lateral side of said selector.

15. A continuous apparatus for forming and packaging stacked article groups, comprising:

(a) a first article infeeder for supplying a first stream of articles in a first travel path;

(b) a second article infeeder for supplying a second stream of articles in a second travel path and at a vertically separate and distinct level with respect to said first article infeeder, said first and said second infeeder each having a plurality of article lanes;

(c) an article group selector having a longitudinal third travel path intersecting said first and second article infeeder travel paths and lanes at a predetermined angle, said selector having a plurality of spaced, transversely oriented flight bars intersecting said first and second article streams which select articles from said first and second infeeder article lanes, said flight bars forming lower article subgroups, upper article subgroups and a stream of spaced, stacked article groups, each said stacked article group comprising a lower and an upper article subgroup;

(d) a divider deposit mechanism for depositing a divider member between said upper and lower article subgroups, said article group selector further slidingly forming said upper article subgroups across said divider member disposed on said lower article subgroups to simultaneously form said stacked article groups;

(e) a carton supplier having a longitudinal fourth travel path parallel to said selector travel path, said carton supplier forming a stream of cartons with open ends facing said article groups on said selector; and (f) a transfer mechanism for loading article groups from said selector to cartons on said carton suppler.

16. A continuous apparatus for forming and packaging stacked article groups, comprising:

(a) a first article infeeder for supplying a first stream of articles in a first travel path;

(b) a second article infeeder for supplying a second stream of articles in a second travel path and at a vertically separate and distinct level with respect to said first article infeeder, said first and said second infeeder each having a plurality of article lanes;

(c) an article group selector having a longitudinal third travel path intersecting said first and second article infeeder travel paths and lanes at an angle, said selector having a plurality of spaced, transversely oriented and fixed flight bars intersecting said first and second article streams which select articles from said first and second infeeder article lanes, said flight bars forming lower article subgroups, upper article subgroups and a stream of spaced, stacked article groups, each said stacked article group comprising a lower and an upper article subgroup;

(d) means to deposit a divider member between said upper and lower article subgroups, said article group selector further slidingly forming said upper article subgroups across said divider member disposed on said lower article subgroups to simultaneously form said stacked article groups;

(e) a carton supplier having a longitudinal fourth travel path parallel to said selector travel path, said carton supplier forming a stream of cartons with open ends facing said article groups on said selector; and (f) a continuous side loading mechanism having a plurality of loader heads fixed at spaced intervals on endless means disposed about a plurality of drive/idler means, said loader heads being synchronized to contact and move a stacked article group on said selector to a carton on said carton supplier, said loader heads, endless means and drive/idler means being constructed and arranged to form a sloping face whereby said loader heads approach said stacked article groups at an angle and continuously contact said stacked article groups while moving transversely and longitudinally.

* * * * *